US008356499B2

(12) United States Patent
Peng

(10) Patent No.: US 8,356,499 B2
(45) Date of Patent: Jan. 22, 2013

(54) ELECTRIC LOCK

(75) Inventor: Fu-Chang Peng, Taipei (TW)

(73) Assignee: Fu Chang Locks Mfg Corp., Taipei County (TW)

( * ) Notice: Subject to any disclaimer, the term of this patent is extended or adjusted under 35 U.S.C. 154(b) by 189 days.

(21) Appl. No.: 12/832,073

(22) Filed: Jul. 8, 2010

(65) Prior Publication Data

US 2012/0006082 A1 Jan. 12, 2012

(51) Int. Cl.
*E05B 47/06* (2006.01)

(52) U.S. Cl. ..... 70/283; 70/280; 70/472; 70/279.1; 70/224; 70/278.1

(58) Field of Classification Search ..... 70/468, 70/472, 280–283, 221–224, 218, 279.1, 277, 70/278.1, 278.7
See application file for complete search history.

(56) References Cited

U.S. PATENT DOCUMENTS 5,018,375 A * 5/1991 Tully ..... 70/472
5,083,122 A * 1/1992 Clark ..... 340/5.22
5,113,675 A * 5/1992 Uyeda ..... 70/477
5,421,178 A * 6/1995 Hamel et al. ..... 70/283
5,694,798 A * 12/1997 Nunez et al. ..... 70/283
5,782,118 A * 7/1998 Chamberlain et al. ..... 70/278.3
6,038,896 A * 3/2000 Chamberlain et al. ..... 70/279.1
6,412,318 B1 * 7/2002 Shen ..... 70/217
6,802,194 B1 * 10/2004 Shen ..... 70/223
7,007,527 B1 * 3/2006 Zehrung ..... 70/278.7
7,231,791 B2 * 6/2007 Sakai ..... 70/277
7,543,469 B1 * 6/2009 Tseng et al. ..... 70/472
7,918,114 B2 * 4/2011 Walsh, III ..... 70/283
8,051,689 B1 * 11/2011 Shen et al. ..... 70/224
2004/0040353 A1 * 3/2004 Yu et al. ..... 70/107
2009/0025438 A1 * 1/2009 Don et al. ..... 70/224
2012/0198897 A1 * 8/2012 Lui ..... 70/280

* cited by examiner

*Primary Examiner* — Suzanne Barrett
(74) *Attorney, Agent, or Firm* — Leong C. Lei

(57) ABSTRACT

An electric lock includes an outer door assembly, a nexus, an inner door assembly, and a latch bolt. The outer lock assembly is arranged to an outer side of a door. The nexus is connected to the outer door assembly. The inner door assembly is connected to the nexus and arranged to an inner side of the door. The latch bolt is connected to a latch bolt retaining unit of the nexus. An actuator of the nexus will move an engagement rod and a protruded block forward to engage an outer handle to the nexus for opening the door when inputting a correct password to the electric lock. The door can be opened by a proper key also. The nexus will be isolated from the outer handle to prevent damage to the nexus when a user does not have a right key and a correct password to the electric lock.

3 Claims, 13 Drawing Sheets

ELECTRIC LOCK

TECHNICAL FIELD OF THE INVENTION

The present invention relates to a door lock, and particular to an electric lock.

DESCRIPTION OF THE PRIOR ART

Home and property safety and door entrance security are seriously concerned by people nowadays. Therefore, multiple door locks are usually applied to a single door to increase the safety.

To improve residential security, electric locks for doors are provided to market. To ensure the safety of a door, the door can be mounted with an electric lock which can only be opened after a correct password is inputted and a proper key is inserted. However, if the password or the key for the door is not available, the user might need to break the lock by rotating the door handle forcibly for the purpose of opening the door. Apparently the broken electric lock is no longer functional, and additional cost is needed for repairing or replacement. Thieves might also break into the door through this way. Thus, there is a need to develop an electric lock to solve the defects of the conventional lock.

SUMMARY OF THE INVENTION

Accordingly, the primary object of the present invention is to provide an electric lock for applying to a door so that a user can open the door without a door key.

Through the present invention, an actuator of a nexus of the electric lock will move a guiding block and a protruded block forward to engage the outer handle of a door to the nexus for opening the door when a user inputs a correct password to the electric lock. The door can be opened by its key also. The nexus will be isolated from the outer handle to prevent damage to the nexus when a user does not have a right key and a correct password to the electric lock.

DETAILED DESCRIPTION OF THE PREFERRED EMBODIMENTS

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
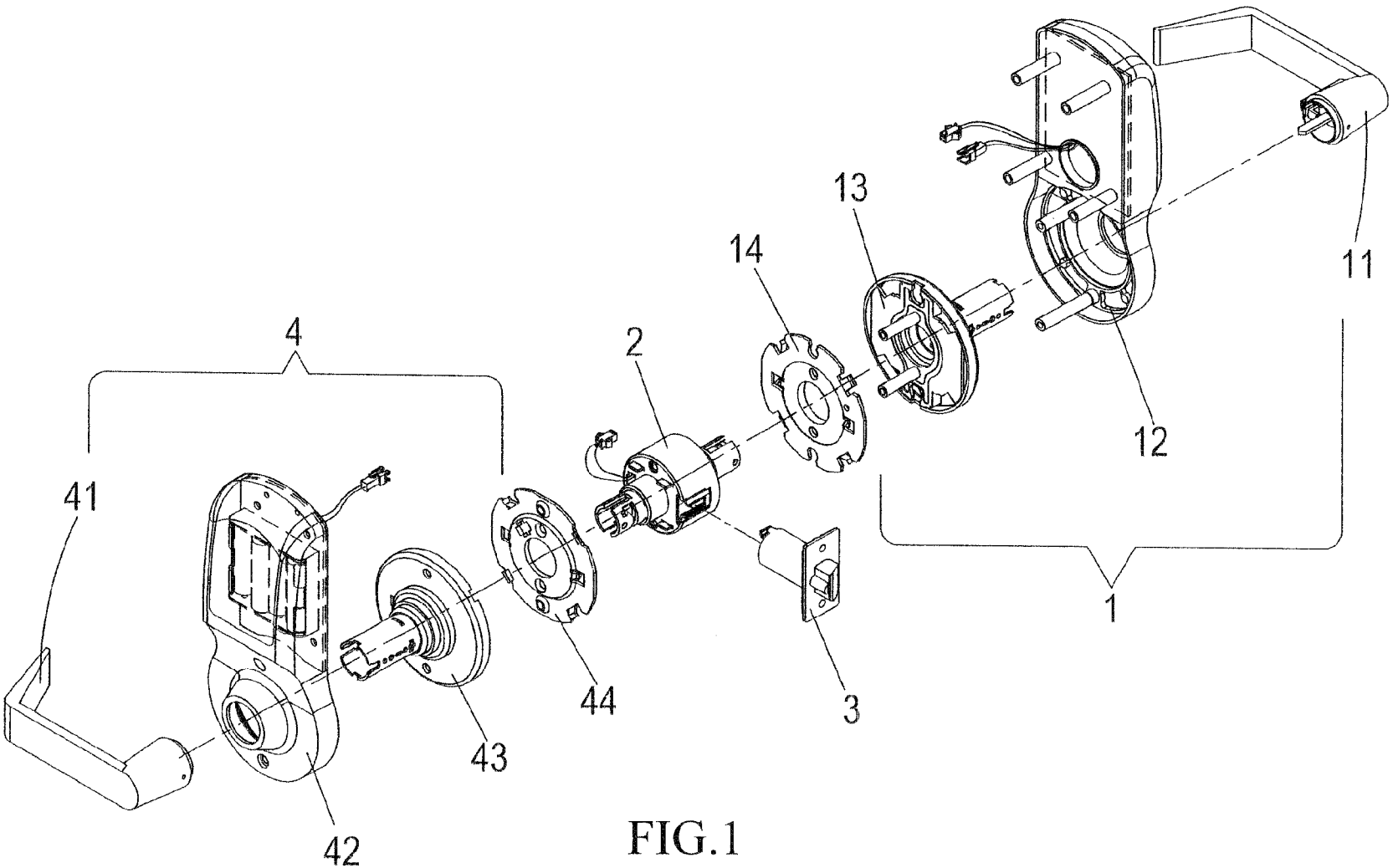
FIG. 1 is an exploded view showing an electric lock of the present invention.

Referring to FIG. 1, an exploded view of the present invention is illustrated. An outer lock assembly 1 is arranged to an outer side of a door. The outer lock assembly 1 includes an outer handle 11, an outer panel 12, an outer transmitting unit 13, and an outer retaining plate 14. The outer transmitting unit 13 is slid and arranged to the outer panel 12 from an inner side of the outer panel 12, and the outer handle 11 is connected to the outer transmitting unit 13 from an outer side of the outer panel 12. Then, the assembled components are fixed to the outer retaining plate 14. A nexus 2 is connected to the outer lock assembly 1, and an inner lock assembly 4 is also connected to the nexus 2. The inner lock assembly 4 is arranged to an inner side of the door. The inner lock assembly 4 includes an inner handle 41, an inner panel 42, an inner transmitting unit 43 and an inner retaining plate 44. The inner transmitting unit 43 is slid and arranged to the inner panel 42 from an inner side of the inner panel 42, and the inner handle 41 is connected to the inner transmitting unit 43 from an outer side of the inner panel 42. Then, the assembled components are fixed to the inner retaining plate 44. A latch bolt 3 is linked to a latch bolt retaining unit 23 of the nexus 2, as will be frilly described in the following. The outer transmitting unit 13 and the inner transmitting unit 43 both have a spring serving to restore the rotated handles. The outer handle 11 has a key hole, lock core, and a column linked together. The column passing through the outer transmitting unit 13 is connected to the nexus 2. The lock core will drive the column while a user uses a key so that the nexus 2 will also be driven by the key to open the door. Since this way of opening a door is a conventional technique, a detailed description therefor is eliminated here.

Figure 2:
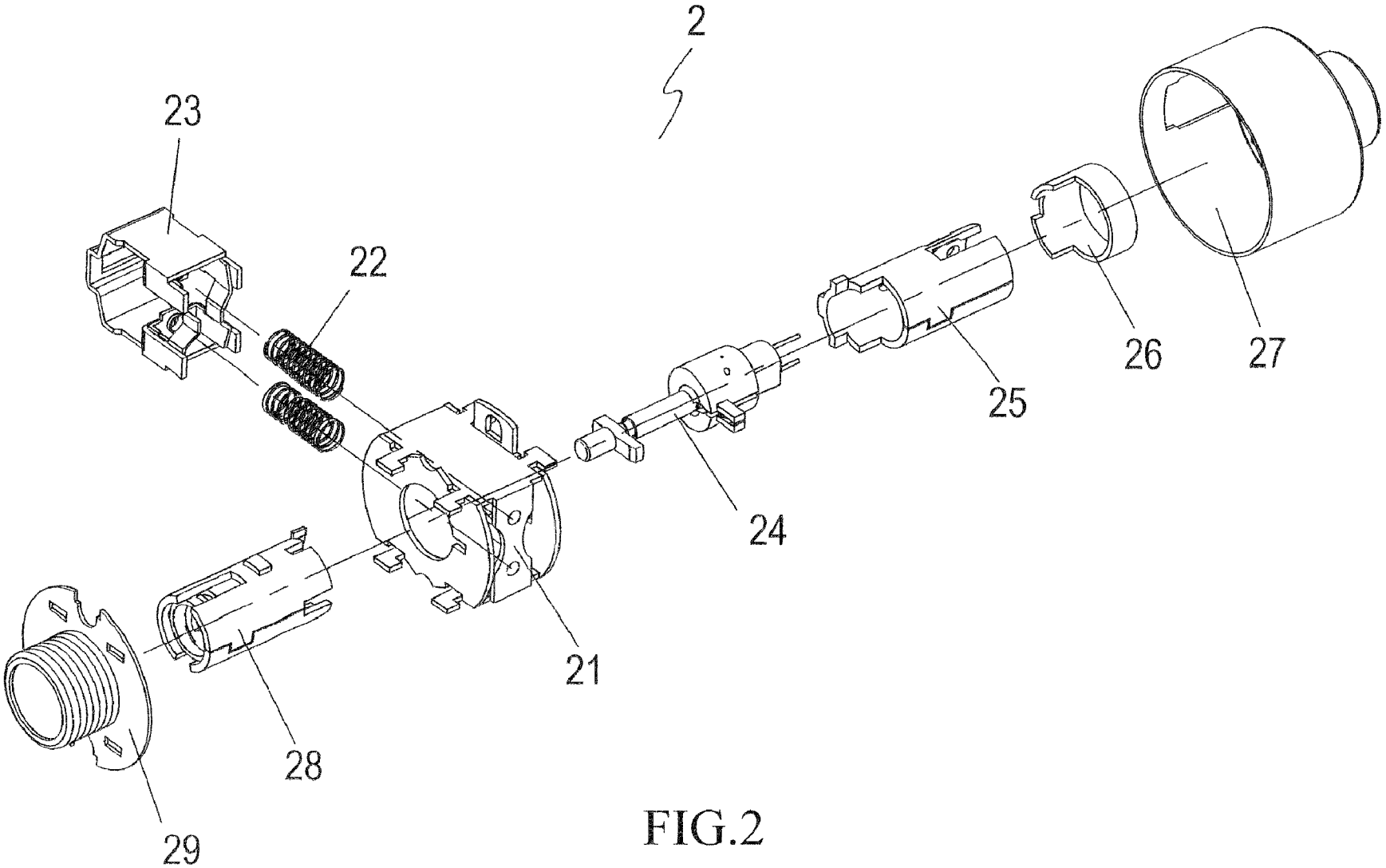
FIG. 2 is an exploded view showing a nexus of the electric lock of the present invention.
Figure 3:
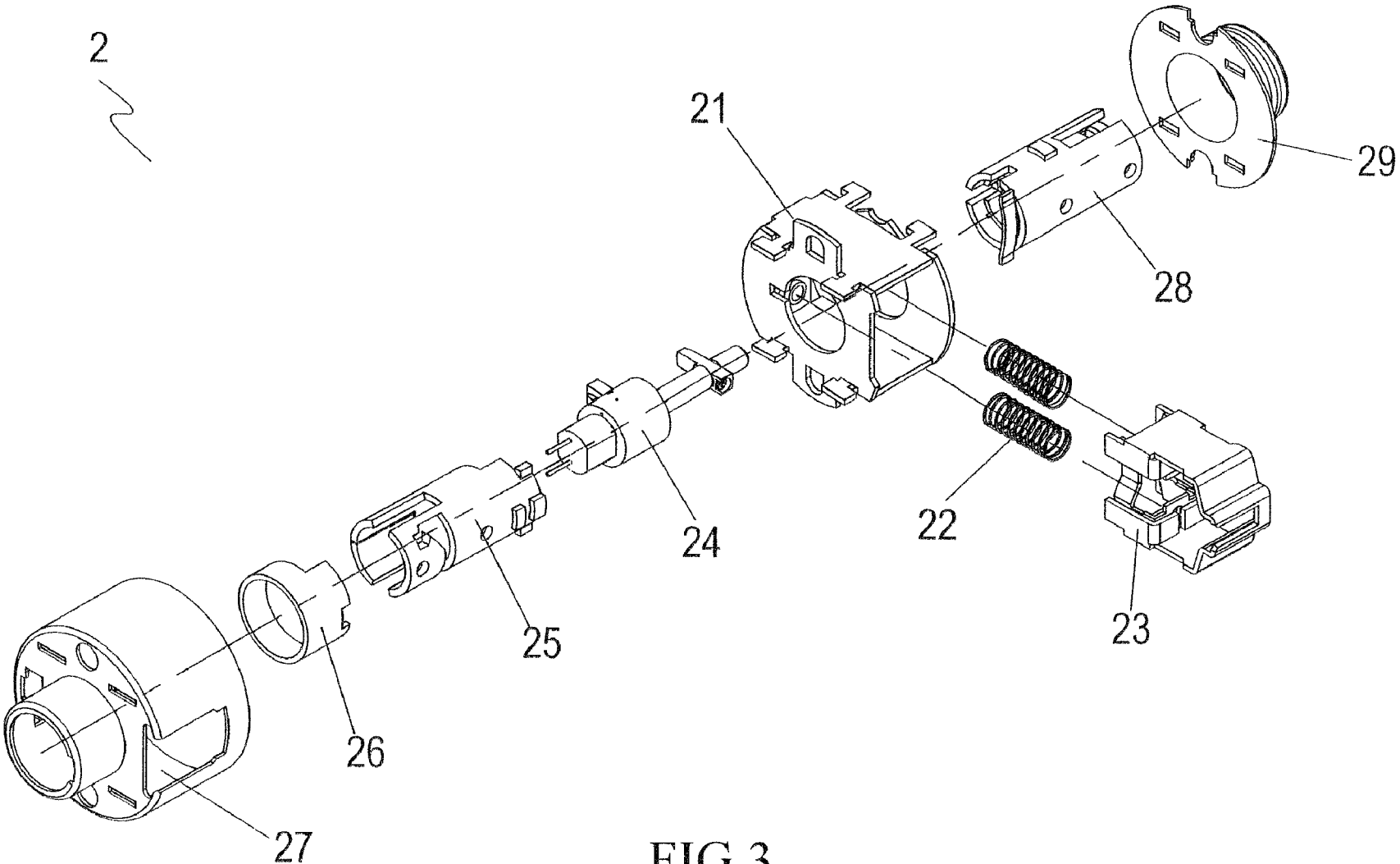
FIG. 3 is an exploded view showing the nexus of the electric lock of the present invention from a different angle.

Referring to FIGS. 2 and 3, the nexus 2 includes a base 21, a latch spring unit 22, a latch bolt retaining unit 23, an actuator 24, a first transmitting unit 25, a sleeve 26, a cover 27, a second transmitting unit 28, and a base retaining unit 29. The latch bolt retaining unit 23 is mounted in the nexus base 21, and the latch spring unit 22 is provided between the latch bolt retaining unit 23 and the base 21. The actuator 24 is arranged in the first transmitting unit 25 and the base 21. The sleeve 26 and the nexus cover 27 are slid upon the first transmitting unit 25 and the base 21 respectively. The first transmitting unit 25 is slid in the base 21 from a side of the base 21. The second transmitting unit 28 is slid to the base 21 from an opposite side of the base 21, and the base retaining unit 29 is arranged upon the second transmitting unit 28 and the base 21.

Figure 4:
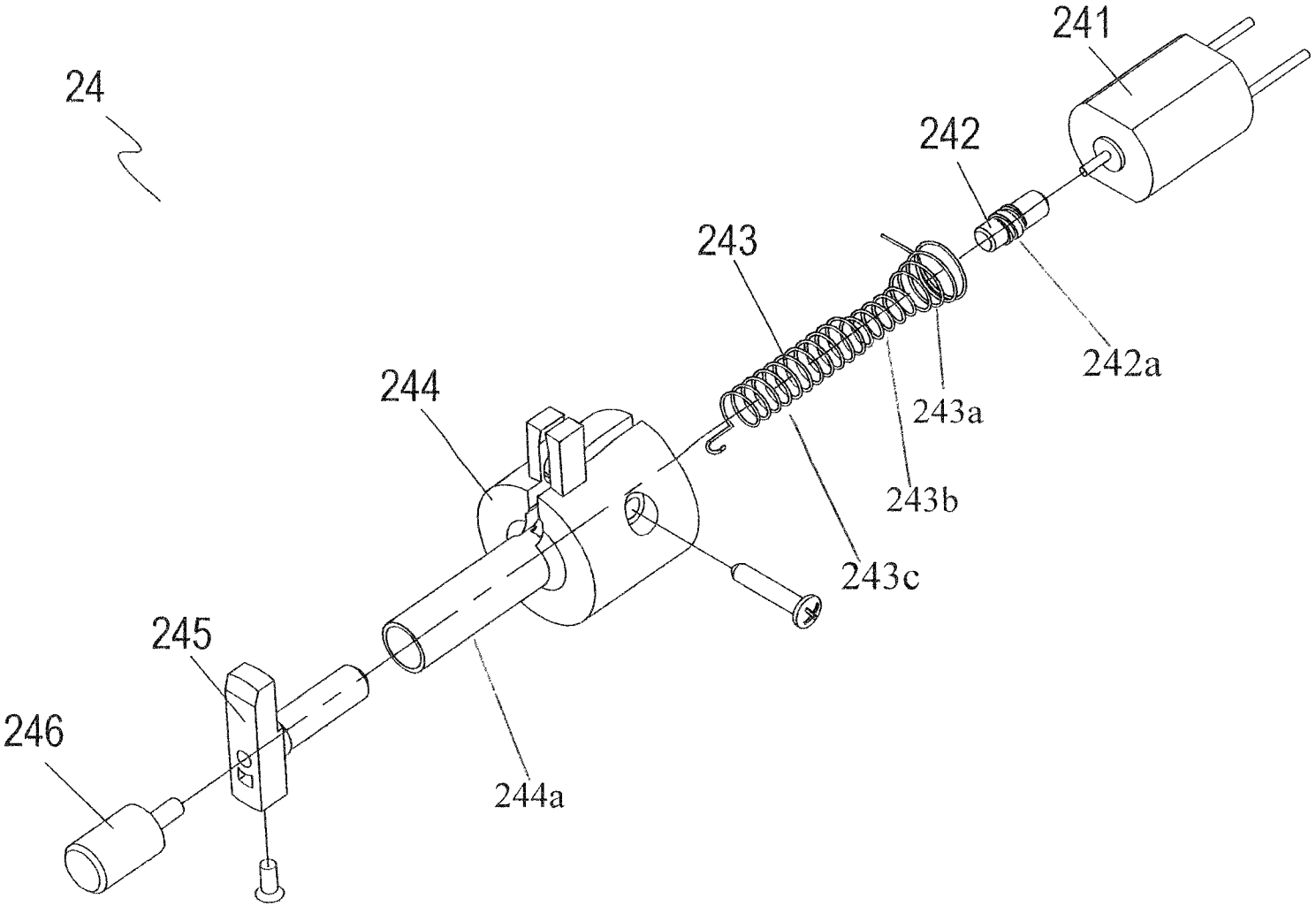
FIG. 4 is an exploded view showing an actuator of the electric lock of the present invention.
Figure 5:
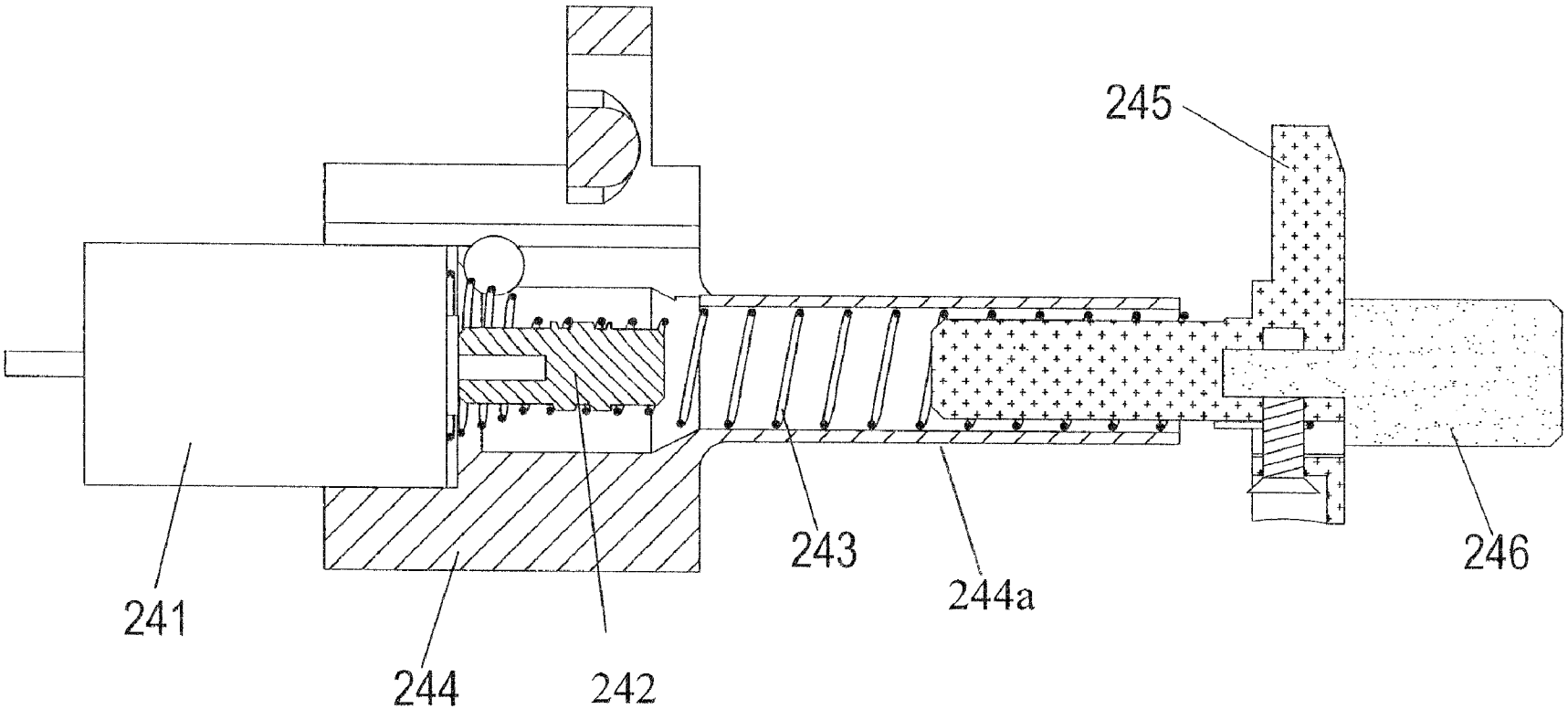
FIG. 5 is a cross section view showing the actuator of the electric lock of the present invention.
Figure 6:
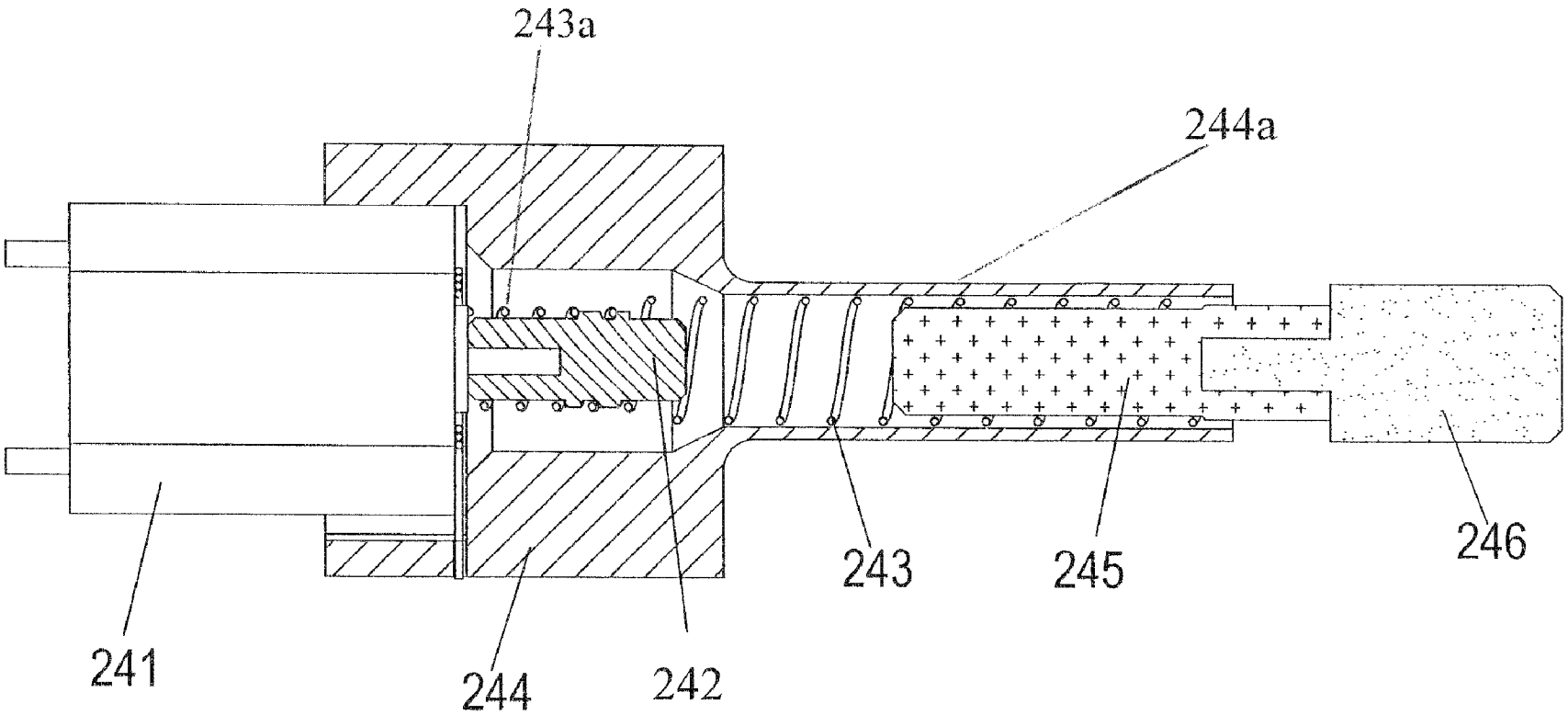
FIG. 6 is a schematic view showing a normal status of the actuator of the electric lock of the present invention, wherein the lock is in an electrically locked condition.
Figure 7:
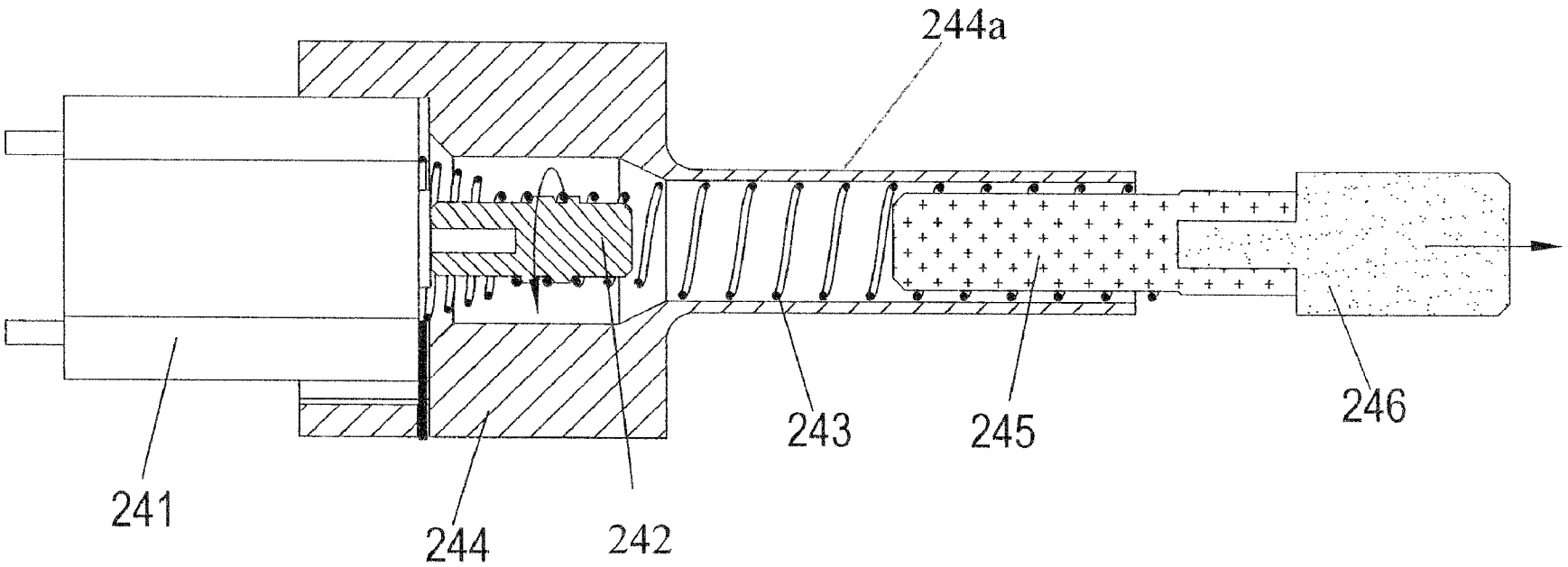
FIG. 7 is a schematic view showing an operation of the actuator of the electric lock of the present invention, wherein the engagement rod and the protruded block of the actuator are moved forward.

Referring to FIGS. 4 and 5, the actuator 24 includes a motor 241, a rotor 242, a coil spring 243, a case 244, an engagement rod 245, and a protruded block 246. The rotor 242 is arranged to and driven by the motor 241. The motor 241 is fixed to the case 244 by means of a fastening component. The protruded block 246 is attached to one end of the engagement rod 245. Furthermore, the case 244 is provided with a guiding tube 244*a*. The coil spring 243 is provided through the guiding tube 244*a* and connected between the rotor 242 and the engagement rod 245. The rotor 242 defines a spiral groove 242*a* around a circumference thereof. The coil spring 243 has a first section 243*a*, a second section 243*b*, and a third section 243*c*, the second section 243*b* being located between the first section 243*a* and the third section 243*c*, wherein the first section 243*a* has a dimension greater than the rotor 242 and can be fitted around a rear portion of the rotor 242; the second section 243*b* is fitted in the spiral groove 242*a* of the rotor 242; the third section 243*c* has a dimension less than the guiding tube 244*a* and greater than the engagement rod 244*a* and can be fitted around the engagement rod 245. One end of the coil spring 243 (at the first section 243*a*) is attached to the case 244 whereas the other end of the coil spring 243 (at the third section 243*c*) is attached to the engagement rod 245 by means of a fastening component.

Figure 8:
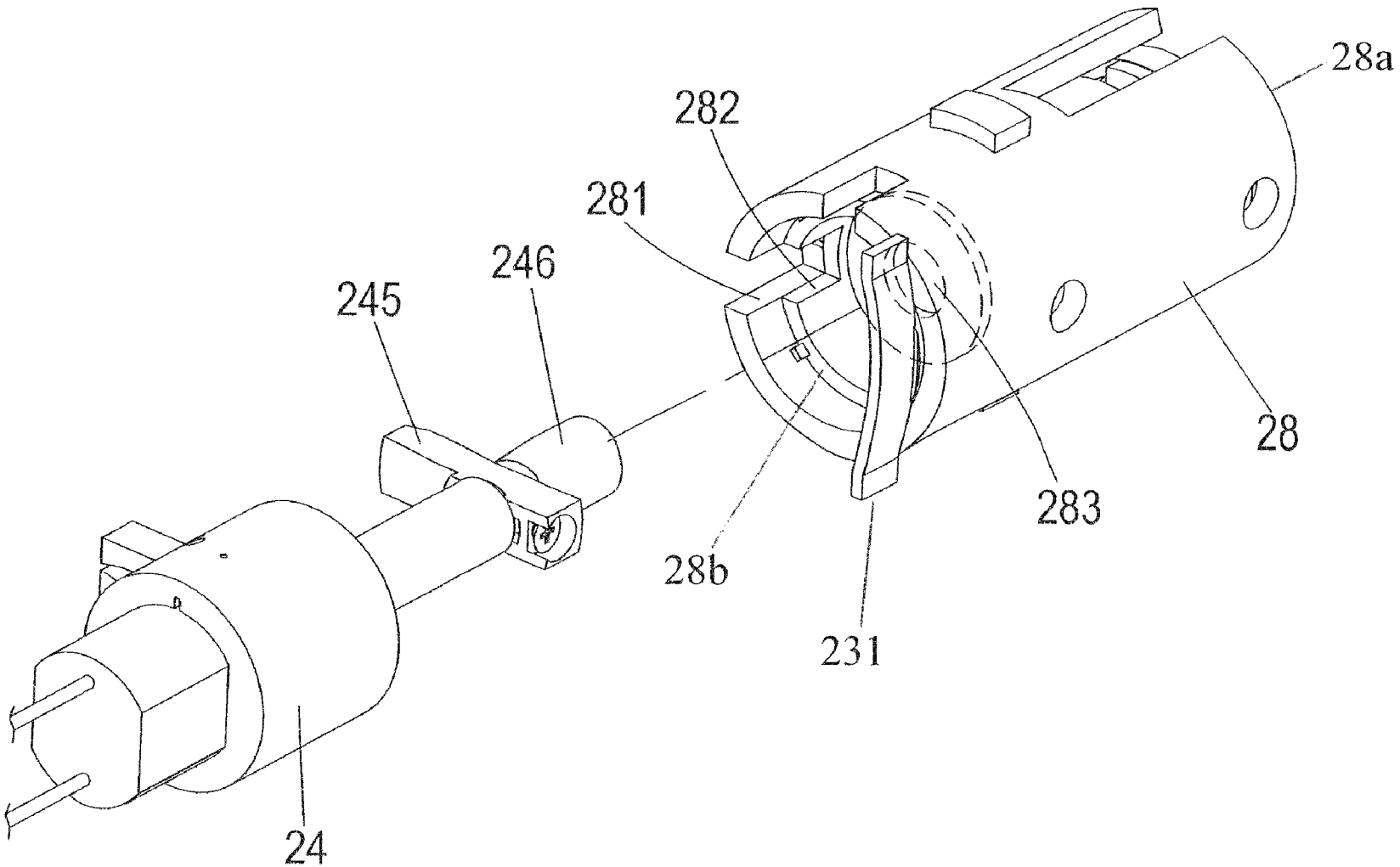
FIG. 8 is a partially exploded view showing the actuator and a second transmitting unit of the electric lock of the present invention.
Figure 9:
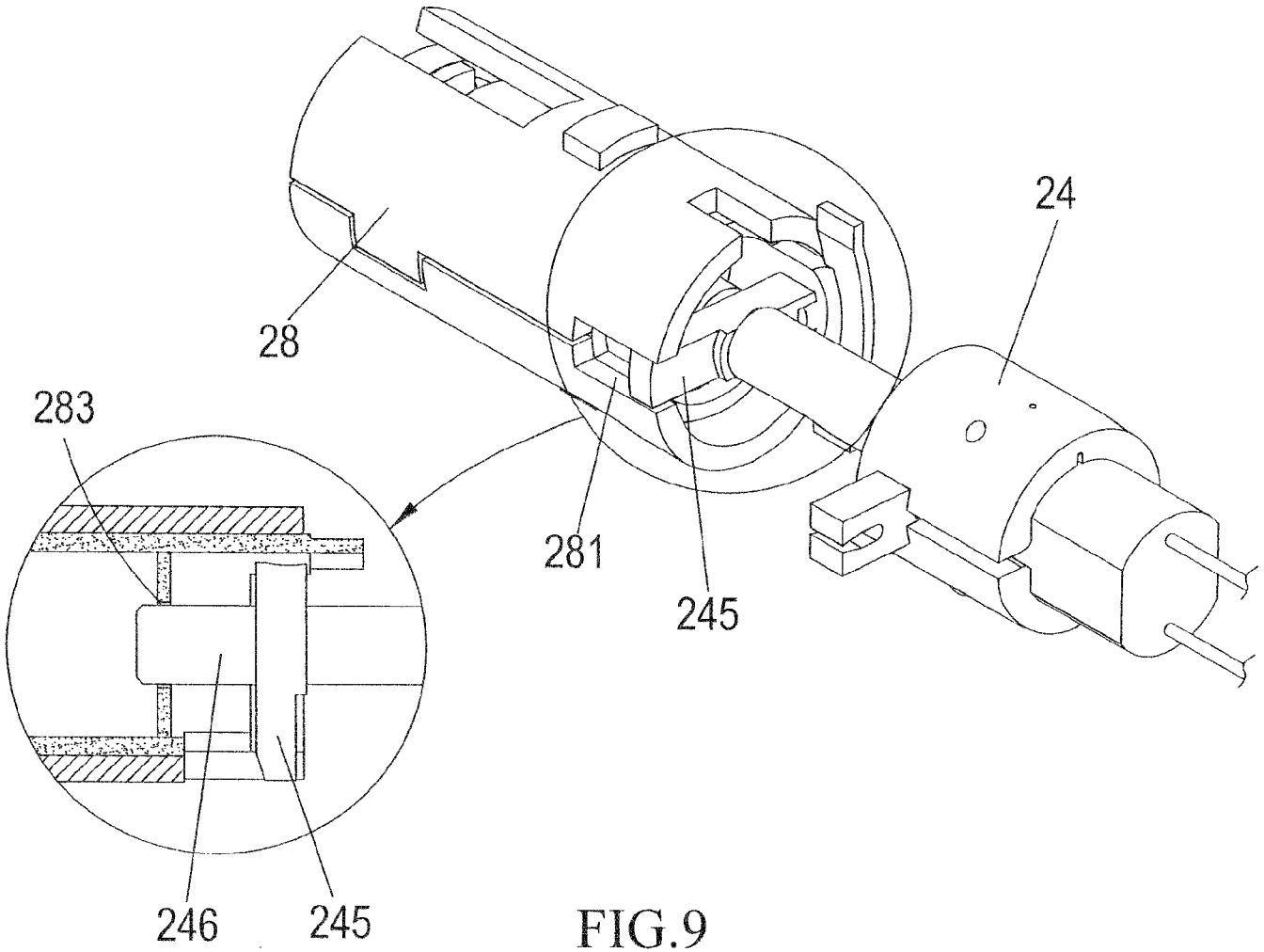
FIG. 9 is a schematic view showing an engagement of the actuator and the second transmitting unit of the electric lock of the present invention.
Figure 10:
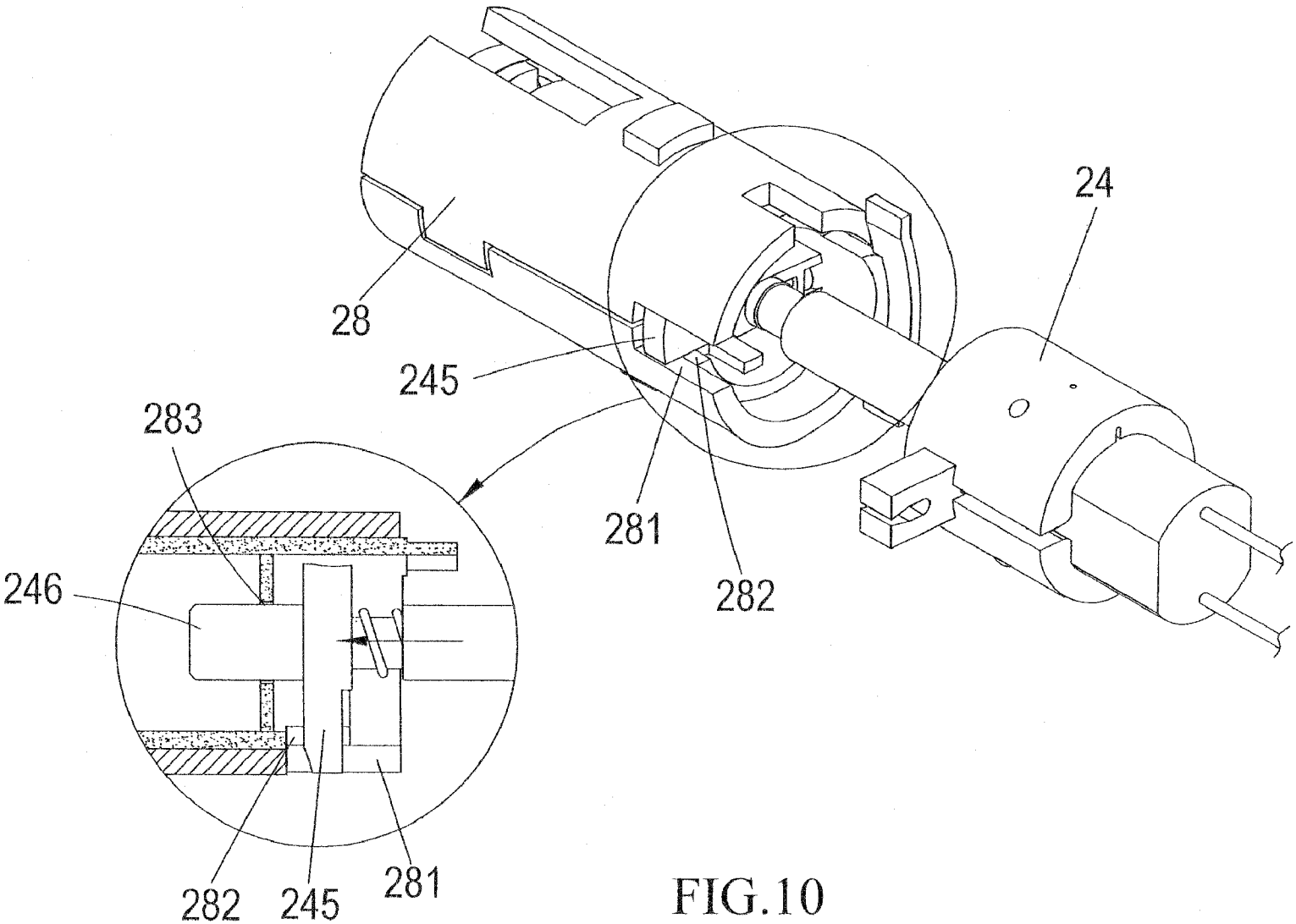
FIG. 10 is a schematic view showing a further engagement of the actuator and the second transmitting unit of the electric lock of the present invention.
Figure 11:
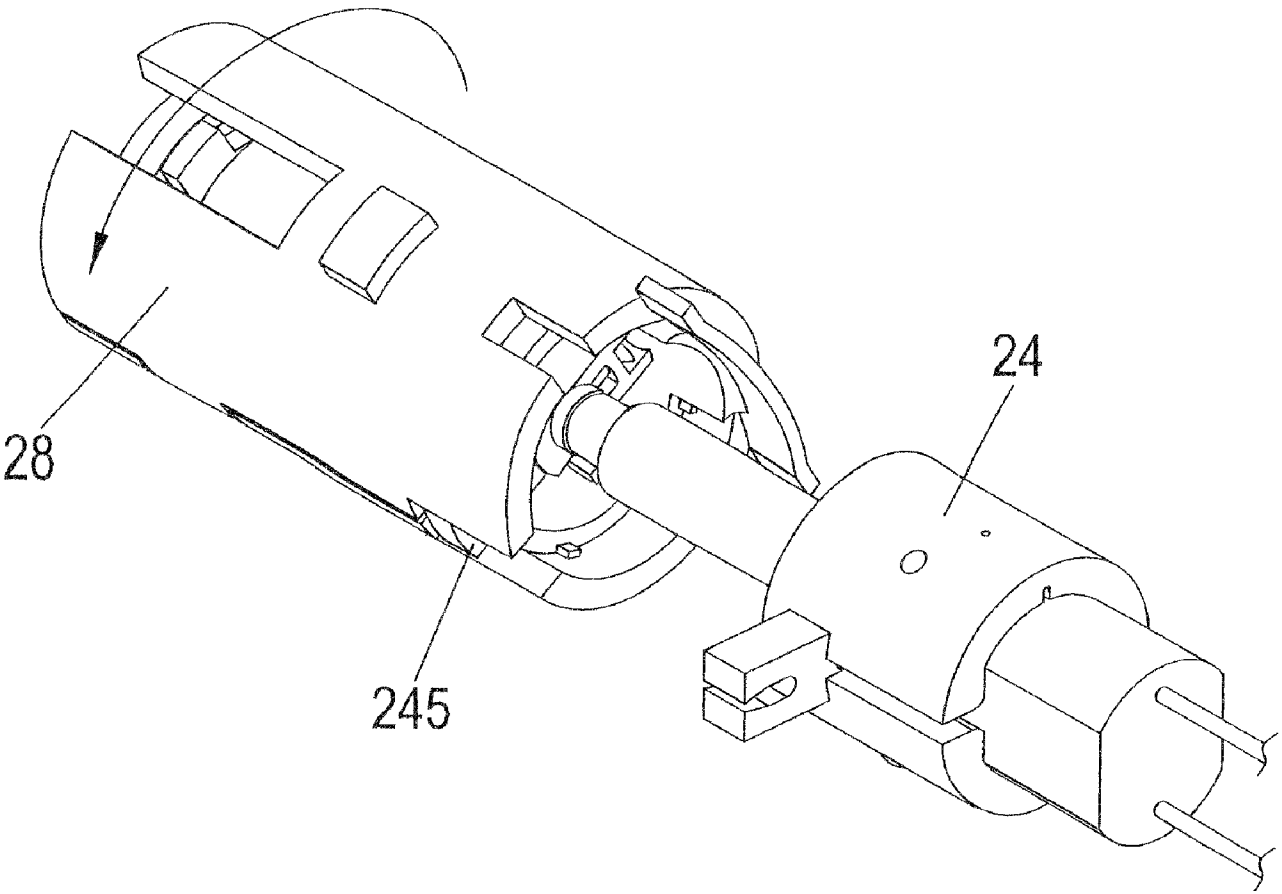
FIG. 11 is a schematic view showing an operation of the actuator and the second transmitting unit illustrated in FIG. 10.

Referring to FIG. 8, the second transmitting unit 28 includes an outer shell 28*a* and an inner shell 28*b* coaxially mounted in the outer shell 28*a*, wherein the outer shell 28*a* defines a first cut 281 and has a driving plate 231; the inner shell 28*b* defines a second cut 282, which is located from the actuator 24 farther than the first cut 281, and a guiding hole 283 for receiving the protruded block 246 for ease of positioning the engagement rod 245; the outer shell 28*a* is capable of engaging with the latch bolt retaining unit 23 by the driving plate 231; the inner shell 28*b* is adapted to engage with the outer handle 11 (not shown).

Referring to FIGS. 6 through 13, the operation of the present invention is illustrated. When the electric lock of the present invention is in an electrically locked condition (see FIGS. 6 and 9), the coil spring 243 is compressed in its first section 243*a*, and the engagement rod 245 is engaged in the first cut 281 of the outer shell 28*a* but is not engaged in the second cut 282 of the inner shell 28*b*, so that rotation of the outer handle 11 cannot be transmitted to the outer shell 28*a*, via the inner shell 28*b*, to open the associated door. When the electric lock of the present invention is inputted with a correct password, the motor 241 can drive the rotor 242 to turn in one direction, so that the coil spring 243 can be driven to extend along the guiding tube 244*a*, thereby moving the engagement rod 245 and the protruded block 246 forward to allow the engagement rod 245 to be further engaged in the second cut 282 of the inner shell 28*b* (see FIGS. 7 and 10). Consequently, the first section 243*a* of the coil spring 243 becomes less compressed, and the outer shell 28*a* and the inner shell 28*b* can be coupled together by the engagement rod 245, so that rotation of the outer handle 11 can be transmitted to the outer shell 28*a*, via the inner shell 28*b*, to have the driving plate 231 urge the latch bolt retaining unit 23 to retract the latch bolt 3 and thus open the associated door (see FIG. 13). When the electric lock of the present invention is electrically reset, the motor 241 can drive the rotor 242 to turn in a reverse direction, so that the coil spring 243 can be driven to contract along the guiding tube 244*a* and thus return to its original condition, wherein the first section 243*a* of the coil spring 243 is further compressed again; the engagement rod 245 is not engaged in the second cut 282 of the inner shell 28*b* of the second transmitting unit 28, and thus rotation of the outer handle 11 cannot be transmitted to the outer shell 28*a*, so that the associated door cannot be opened.

Figure 12:
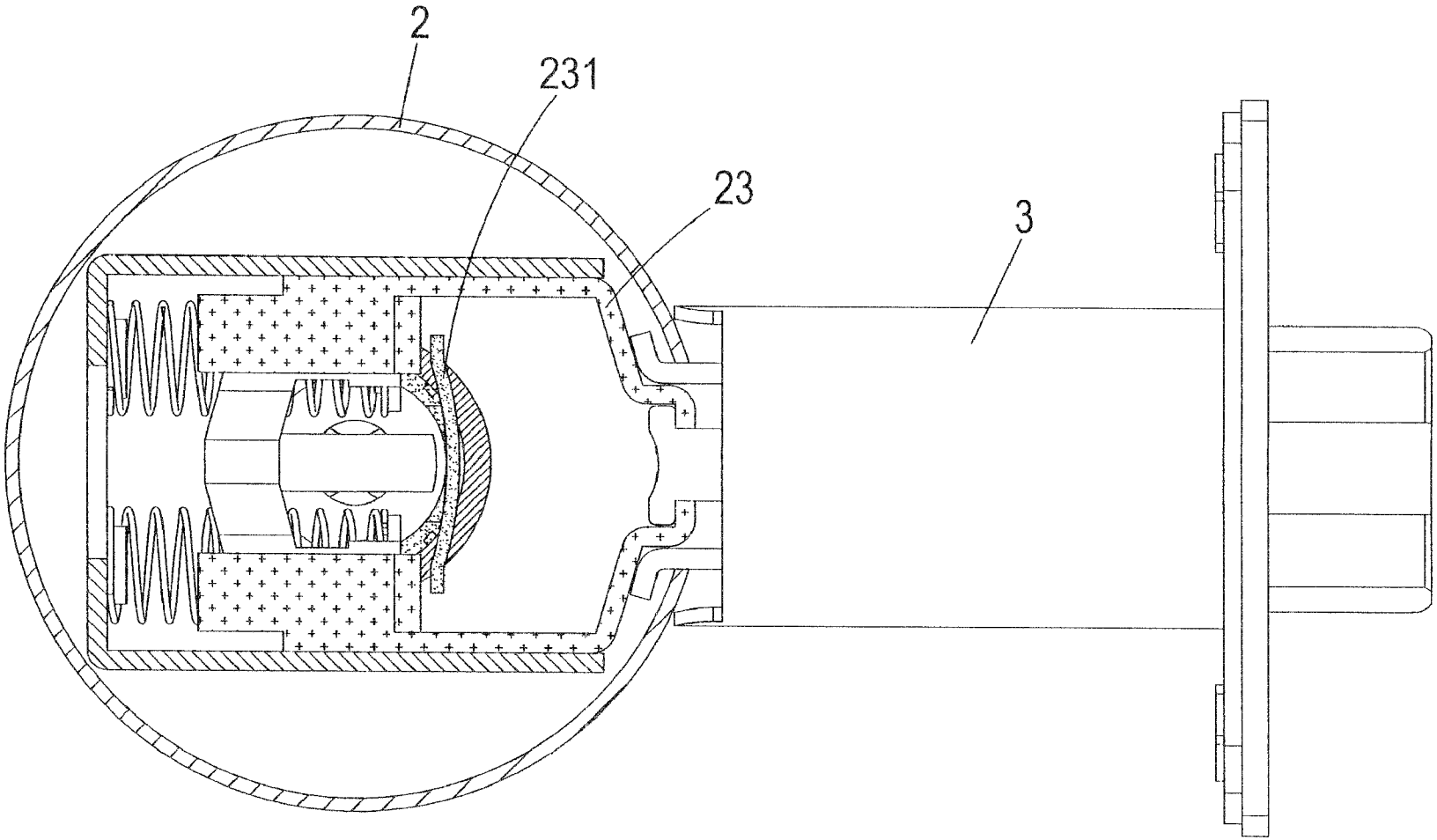
FIG. 12 is a schematic view showing a normal status of a latch bolt of the electric lock of the present invention.
Figure 13:
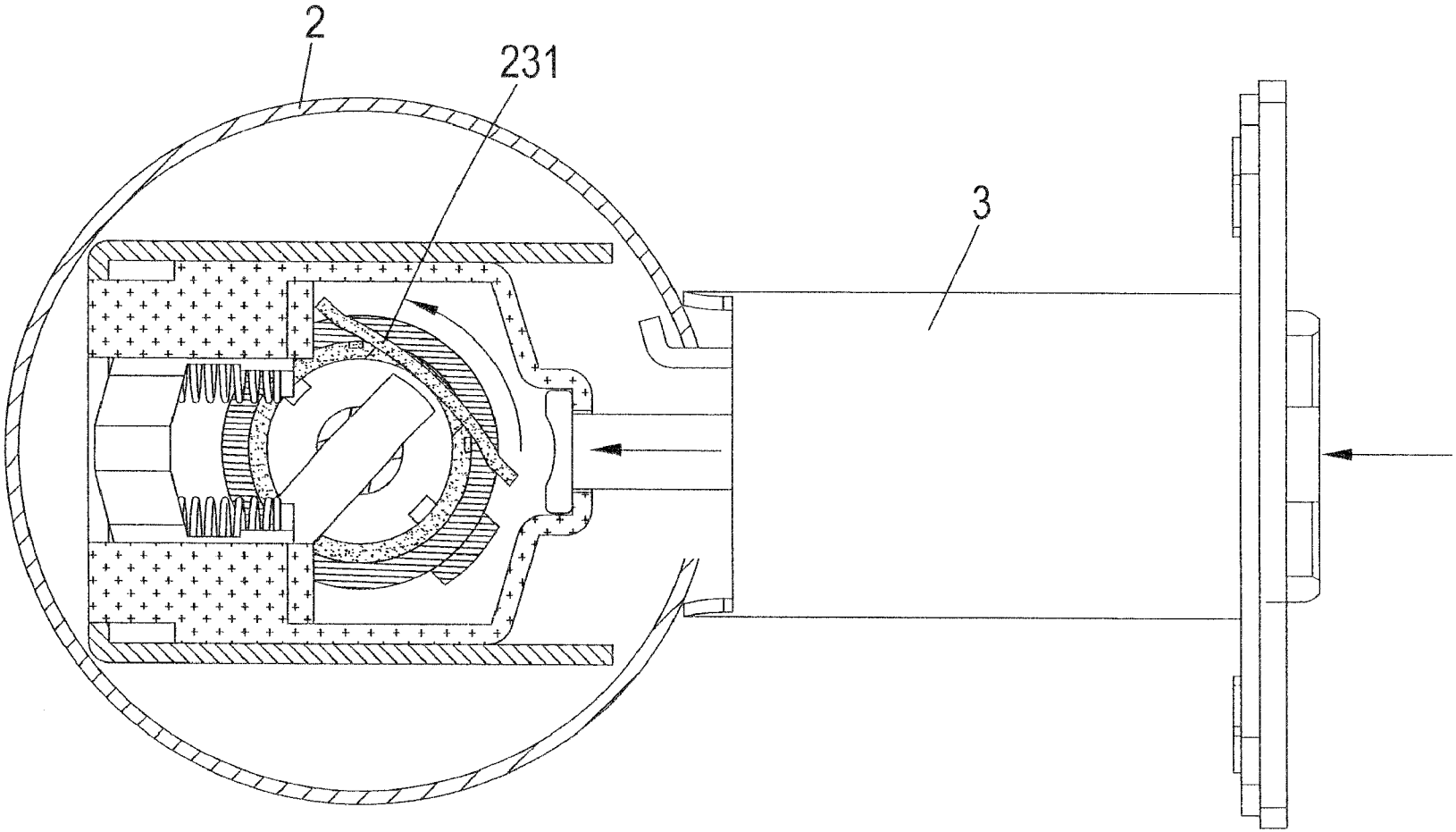
FIG. 13 is a schematic view showing an operation of the latch bolt of the electric lock of the present invention.

Referring to FIGS. 12 and 13, the latch bolt retaining unit 23 is connected to the latch bolt 3. As described above, when the outer shell 28*a* of the second transmitting unit 28 is coupled with the inner shell 28*b* of the second transmitting unit 28 by the engagement rod 245, rotation of the outer handle 11 allows the driving plate 231 of the outer shell 28*a* to urge the latch bolt retaining unit 23 to retract the latch bolt 3, so that the associated door can be opened.

The present invention has the following advantages.

1. Users can open the door without a key.

2. The coil spring 243, connected between the engagement rod 245 and the rotor 242, makes a resilient connection between the actuator 24 and the second transmitting unit 28, which can protect the nexus 2, particularly the actuator 24, from being damaged when using improper tools.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An electric lock comprising:

an outer lock assembly arranged to an outer side of a door plate, the outer lock assembly having an outer handle, an outer panel, an outer transmitting unit, and an outer retaining plate; the outer transmitting unit being slid and arranged to the outer panel from an inner side of the outer panel; the outer handle being connected to the outer transmitting unit from an outer side of the outer panel; the outer retaining plate being fixed to the outer transmitting unit from an inner side of the outer transmitting unit;

a nexus connected to the outer lock assembly, the nexus having a base, a latch spring unit, a latch bolt retaining unit, an actuator, a first transmitting unit, a sleeve, a cover, a second transmitting unit, and a base retaining unit; the latch bolt retaining unit mounted in the base, the latch spring unit provided between the latch bolt retaining unit and the base; the actuator being arranged in the first transmitting unit and the base; the sleeve and the cover being slid upon the first transmitting unit and the base respectively; the first transmitting unit being slid in the base from a side of the base; the second transmitting unit being slid to the base from an opposite side of the base, and the base retaining unit being arranged upon the second transmitting unit and the base;

an inner lock assembly arranged to the nexus from an inner side of the door, the inner locking assembly having an inner handle, an inner panel, an inner transmitting unit and an inner retaining plate; the inner transmitting unit being slid and arranged to the inner panel from an inner side of the inner panel; the inner handle being connected to the inner transmitting unit from an outer side of the inner panel; the inner retaining plate being fixed to the inner transmitting unit from an inner side of the inner transmitting unit; and a latch bolt linked to the latch bolt retaining unit;

wherein the second transmitting unit includes an outer shell and an inner shell coaxially mounted in the outer shell, the outer shell defining a first cut, the inner shell defining a second cut, which is located from the actuator farther than the first cut, the outer shell capable of engaging with the latch bolt retaining unit, the inner shell adapted to be engaged with the outer handle; the actuator includes a motor, a rotor driven by the motor, a coil spring, a case, an engagement rod, and a protruded block, the case being provided with a guiding tube, the coil spring being provided through the guiding tube and connected between the rotor and the engagement rod, the protruded block being attached to one end of the engagement rod, the engagement rod being engaged in the first cut of the outer shell of the second transmitting unit, the rotor defining a spiral groove around a circumference thereof, the coil spring having a first section, a second section, and a third section, the first section having a dimension greater than the rotor and fitted around a rear portion of the rotor, the second section located between the first section and the third section and fitted in the spiral groove of the rotor, the third section having a dimension less than the guiding tube and greater than the engagement rod and fitted around the engagement rod, one end of the coil spring being attached to the case whereas the other end of the coil spring being attached to the engagement rod;

whereby when the electric lock is inputted with a correct password, the motor can drive the rotor to turn in one direction, so that the coil spring can be driven to extend along the guiding tube to move the engagement rod and the protruded block forward to allow the engagement rod to be further engaged in the second cut of the inner shell of the second transmitting unit, so that the outer shell and the inner shell can be coupled together by the engagement rod to allow rotation of the outer handle to be transmitted to the outer shell, which in turn urges the latch bolt retaining unit to retract the latch bolt to open the associated door; when the electric lock is electrically reset, the motor can drive the rotor to turn in a reverse direction, so that the coil spring can be driven to contract along the guiding tube to move the engagement rod and the protruded block backward, so that the outer shell and inner shell can be uncoupled, so that rotation of the outer handle cannot be transmitted to the outer shell of the second transmitting unit, and thus the associated door cannot be opened.

2. The electric lock as claimed in claim 1, wherein the motor is fixed to the case by means of a fastening component.

3. The electric lock as claimed in claim 1, wherein the coil spring is attached to the engagement rod by means of a fastening component.

* * * * *